United States Patent [19]

Jenkins

[11] 4,265,029

[45] May 5, 1981

[54] MOTOR VEHICLE DRYER STAND

[76] Inventor: Kenneth A. Jenkins, 3207 Lakeshore Dr., Old Hickory, Tenn. 37138

[21] Appl. No.: 100,254

[22] Filed: Dec. 4, 1979

[51] Int. Cl.[3] ..... F26B 23/04

[52] U.S. Cl. ..... 34/39; 34/239; 34/243 C; 248/124; 219/348; 219/537

[58] Field of Search ..... 34/4, 39, 243 C, 239; 248/124, 122; 219/348, 349, 520, 537

[56] References Cited

U.S. PATENT DOCUMENTS

| | | | |
|---|---|---|---|
| 1,656,777 | 1/1928 | Dennis | 248/122 |
| 2,057,776 | 10/1936 | Groven | 34/4 |
| 2,387,516 | 10/1945 | Kaminski | 219/348 |
| 2,500,872 | 3/1950 | Root et al. | 219/348 |
| 2,553,094 | 5/1951 | Jarrett et al. | 248/122 |
| 2,610,280 | 9/1952 | Wilson | 219/348 |
| 3,223,826 | 12/1965 | Macaluso, Jr. | 248/124 |
| 3,265,346 | 8/1966 | Petrick | 34/239 |
| 3,269,681 | 8/1966 | Azim | 248/124 |
| 3,509,334 | 4/1970 | Michailov | 219/348 |

*Primary Examiner*—Larry I. Schwartz
*Attorney, Agent, or Firm*—Harrington A. Lackey

[57] ABSTRACT

A motor vehicle dryer stand including a base member having a pair of laterally spaced legs projecting remotely from the base member, a standard projecting upward from the proximal end portion of the base member, an elongated lamp arm and means for clamping one end of the lamp arm at selected vertically adjusted positions on the standard, the lamp arm being of a length sufficient to extend over the top of a motor vehicle for supporting a dryer lamp over the center portion of the motor vehicle when the standard is in a position proximate to the side of the motor vehicle. Both the standard and the lamp arm are adapted to support one or more dryer lamps, and the standard may be fitted with additional lamp arms for supporting additional dryer lamps. The lamp arms extend preferably in the same longitudinal vertical plane of the base member.

3 Claims, 3 Drawing Figures

MOTOR VEHICLE DRYER STAND

BACKGROUND OF THE INVENTION

This invention relates to motor vehicle paint dryers, and more particularly to a stand for supporting lamps for a drying motor vehicle.

Motor vehicle dryers, including standards and means for adjustably supporting one or a plurality of heater lamps upon the standard, are well known in the art. Some of these motor vehicle dryers and stands are disclosed in the following U.S. Pat. Nos.:

2,048,777 Brown: July 28, 1936
2,057,776 Groven: Oct. 20, 1936
2,500,872 Root et al: Mar. 14, 1950
3,223,826 Macaluso, Jr.: Dec. 14, 1965
3,509,334 Michailov: Apr. 28, 1970

All of the stands disclosed in the above patents are adapted to support heat lamps positioned along the side of a motor vehicle for drying the paint or other types of body finishes. One of the patents, Groven U.S. Pat. No. 2,057,776, does disclose one lamp which projects laterally from the vertical standard for radiating down upon a portion of the top of the vehicle along one side.

However, none of the above patents include any support apparatus for holding a dryer lamp over the center portion of the vehicle in order to evenly dry the top flat surface of an automobile hood, or roof.

Furthermore, none of the auto paint dryers disclosed in the above patents, or otherwise known to the applicant, include a cantilever-type support having a base member which projects laterally toward and beneath the motor vehicle while an upper lamp arm supports a dryer lamp over the middle portion of the motor vehicle.

SUMMARY OF THE INVENTION

It is therefore an object of this invention to provide a motor vehicle dryer stand including a generally elongated base member and a standard projecting vertically upward from one end portion of the base member to support a cantilevered lamp arm spaced above and generally parallel to the base member. One or more dryer lamps are mounted at selected positions along the lamp arm and also along the vertical standard in order to provide substantially even drying of the paint or finish on practically any area of the motor vehicle, including the middle portion of the vehicle.

The dryer stand made in accordance with this invention includes a base member having proximal and remote end portions, the vertical standard projecting upward from the proximal end portion, while a pair of laterally spaced legs project remotely from the standard to provide a stable base for an upper cantilevered lamp arm of sufficient length to extend over the middle portion of the motor vehicle while the standard is positioned adjacent one side of the vehicle.

The transversely spaced legs in the base member are designed non only to give transverse stability to the stand, but also to straddle a tire or wheel on the motor vehicle which is being dried by the lamps mounted on the dryer stand.

The base member is preferably provided with a pair of transversely spaced caster members on opposite sides of the longitudinal axis of the base member and adjacent the proximal end portion of the base member, while the remote ends of the spaced legs depend in a pair of foot members for frictionally engaging the surface upon which the stand is supported.

A gusset member, or triangular plate, is fixed in a vertical plane to the bottom portion of the standard and to the base member in order to reinforce the stand against the forces and moments developed in the cantilevered lamp arm loaded with dryer lamps.

The dryer stand made in accordance with this invention is also versatile enough to support one or more heat lamps, not only on the lamp arms, but also upon the standard itself. The standard is adapted to support additional lamp arms, preferably projecting in the same plane as the longitudinal axis of the base member, in either direction from the standard. Thus, lamp arms can project in opposite longitudinal directions from the standard, or two or more lamp arms can project in the same direction from the standard at vertically spaced intervals, while supporting a plurality of lamps.

The versatility of the dryer stand made in accordance with this invention permits the drying of practically all portions of the finished surface of a motor vehicle, including automobiles, vans, trucks, and tractor-trailers.

DESCRIPTION OF THE PREFERRED EMBODIMENTS

Figure 1:
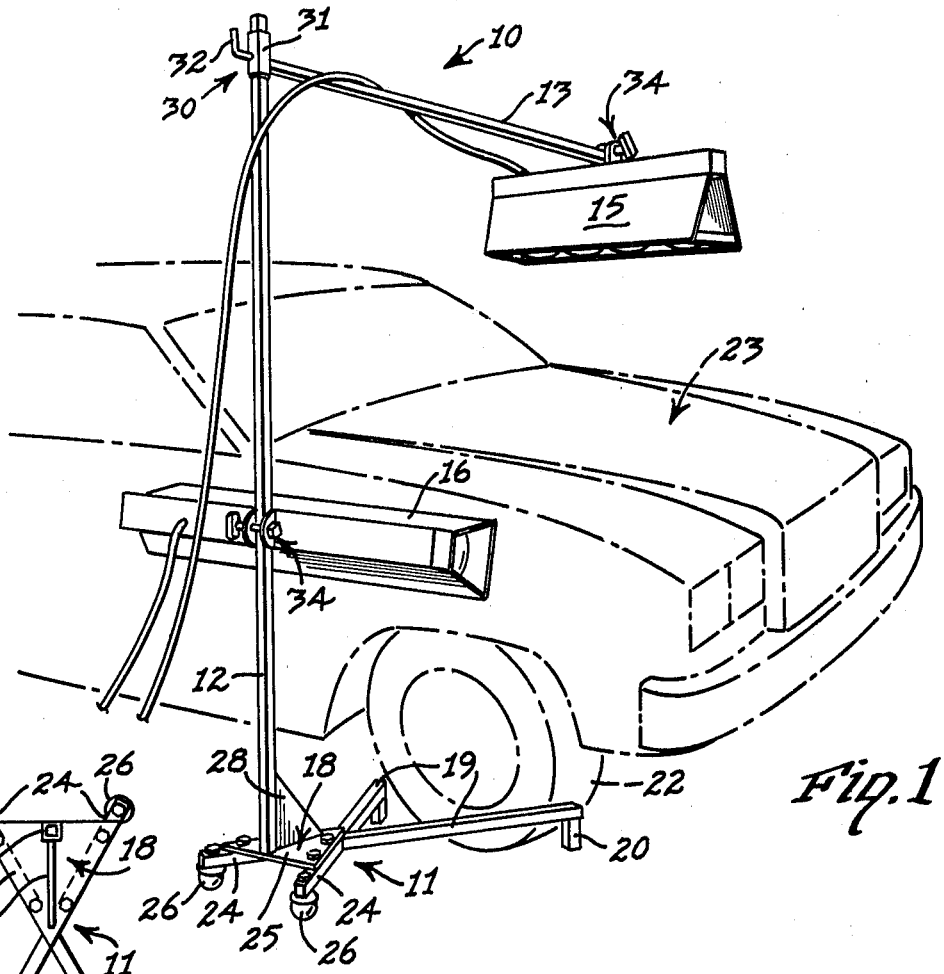
FIG. 1 is a rear perspective view of the dryer stand made in accordance with this invention, supporting heat lamps for drying the hood and fender of an automobile, shown in phantom.

Referring now to the drawings in more detail, the dryer stand 10 made in accordance with this invention includes generally a base member 11 upon which is supported an upward projecting vertical standard 12, upon which is mounted in selective vertically adjustable positions, one or more lamp arms 13 and 14 (FIG. 3), adapted to support one or more dryer lamps 15, 15'. Lamps 16 and 16' are also adapted to be mounted upon the vertical standard 12.

The base member 11 preferably has a platform member 18 adjacent its proximal end portion, and a pair of transversely spaced legs 19 which project generally in a remote longitudinal direction from the platform member 18. As disclosed in the drawings, the legs 19 diverge in a V-shape and intersect at their proximal ends in the platform member 18. The remote ends of the legs 19, which also constitutes the remote end portion of the base member 11, terminate in a pair of depending feet or foot members 20. The legs 19 preferably diverge from the longitudinal axis of the base member 11, in the remote direction, in order to straddle the wheel 22 of a motor vehicle 23 adapted to be dried by the heat lamps 15 and 16 on the stand 10, as best disclosed in FIG. 1. The straddling legs 19 permit the standard 12 to be positioned closer to the vehicle 23 and enables the lamp arm 13 to project farther across the vehicle 23.

The platform member 18, adapted to support the vertical column 12, is preferably constructed of a V-shaped framework which consists of the proximal diverging longitudinal extensions 24 of the legs 19 from the intersection of the legs 19. Bolted to the tops of the leg extensions 24 is a triangular base plate 25.

Depending from the rear or proximal extremities of the leg extensions 24 are a pair of transversely spaced caster or roller members 26. The caster members 26 are transversely spaced on opposite sides of the longitudinal axis of the base member 11 so as to provide lateral stable support for the standard 12.

The bottom end portion of the standard 12 is fixed to the base plate 12 by welding or any other desired means. Also, in order to resist forces and moments resulting from the cantilevered lamp arm 13, a gusset member, specifically in the form of a triangular web plate 28, is fixed in a vertical plane along the longitudinal axis of the base member 11 to, and between, the base plate 25 and the bottom portion of the standard 12, as best disclosed in FIGS. 1 and 2.

In order to mount the lamp arm 13 at selectively different elevations upon the standard 12, the proximal end of the lamp arm 13 is provided with a clamp member 30, including a sleeve fixed to lamp arm 13 and adapted to slidably fit over the standard 12, and a clamping set screw 32. As disclosed in the drawings, the standard or column 12 is preferably of square tubular stock. Consequently, the sleeve 31 is also of square cross-section, and of slightly greater dimension in order to freely slide over and along the standard 12. The elevation of the lamp arm 13 is therefore readily adjusted to any desired elevation by rotating the clamping set screw 32 in one direction to release the clamp member 30, and in the opposite direction to secure the clamp member 30 to the standard 12.

Each of the heater or dryer lamps 15 and 16 is of known construction, and per se, form no part of the invention. The dryer lamps 15 and 16 may include three or four infrared bulbs or lights or may include quartz tube banks or infrared quartz tube banks, all of known construction.

Each of the lamps 15 and 16 is clamped to a lamp arm 13 or 14 or the standard 12 by means of identical known clamp mechanisms 34, including a pair of ears for straddling the particular standard or arm and a bolt for squeezing the ears together.

Some of the lamps, such as 15 and 15' (FIG. 3) may be mounted on their respective lamp arms 13 and 14 by adjustable bracket arms 35.

Figure 2:
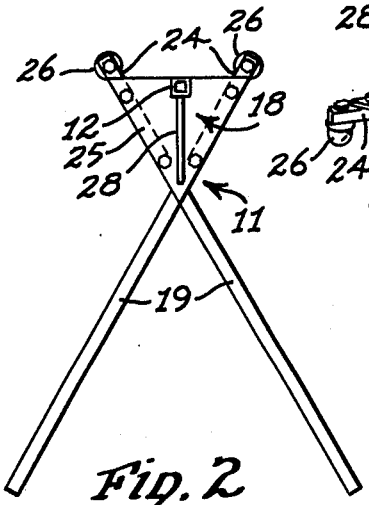
FIG. 2 is a top plan view of the dryer stand, with the lamp arms removed.

As viewed in FIG. 1, the preferred arrangement of lamps 15 and 16 for drying the front fender and hood of a automobile 23 is disclosed. The stand 10 includes a single lamp arm 13 clamped by the clamping member 30 adjacent the top of the standard 12, and supporting near its free end the lamp 15 clamped to the free extremity of the lamp arm 13 by the clamp member 34. This lamp 15 is designed to extend transversely of the longitudinal axis of the lamp arm 13. In turn, the lamp arm 13 is designed to have its longitudinal axis substantially parallel and spaced above the longitudinal axis of the base member 11. The lamp arm 13 is preferably longer than the longitudinal extent of the base member 11 and sufficiently long that the lamp 15 will be supported over the mid portion of the car in order that the radiation from the lamp 15 will evenly dry the top surface of the hood 23.

At the same time, the lamp 16 is mounted by its clamp member 34 at the desired height on the standard 12 so that it will provide maximum, and even, radiation for drying the front fender of the automobile 23.

Figure 3:
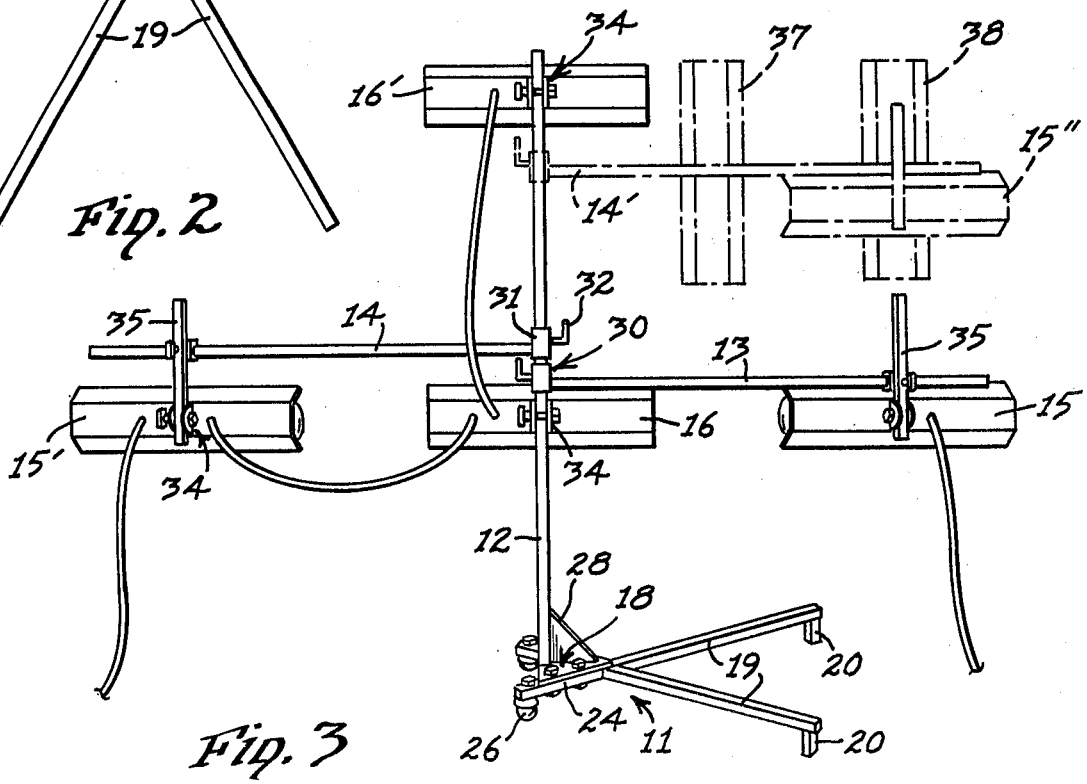
FIG. 3 is a side elevation of the dryer stand in which two lamp arms are mounted on the standard for supporting dryer lamps in various positions, and also illustrating optional positions of a lamp arm and dryer lamps, in phantom.

FIG. 3 discloses various arrangements of the lamps and lamp arms in order to provide maximum drying effectiveness for various surface areas of the particular motor vehicle whose paint or finish is to be dried.

Where it is desired only to dry a large longitudinal limited surface area of the side of the motor vehicle, then a single lamp arm 13 supporting a lamp 15 may be clamped to the standard 12 by the clamp member 30, as illustrated in FIG. 3. Futhermore, the lamp 16 is clamped to the standard 12 by its clamp member 34 immediately below the clamp member 30.

Where it is desired to dry the entire side of the automobile 23 at once, then the same arm 13 with the lamps 15 and 16 will be retained, and a lamp arm 14 supporting the bracket 35 and lamp 15' is added so that the lamp arm 14 will project in the same longitudinal plane, but in the opposite direction from the lamp arm 13. It will be noted in FIG. 3 that the lamp arms 13 and 14 lie substantially in the same vertical plane as the longitudinal axis of the base member 11 in order to provide the most stable support for the dryer lamps 15, 16 and 15'.

For drying the entire side of a larger vehicle, such as a van, tractor or trailer, the same lamp arms 13 and 14 and lamps 15, 16 and 15', as previously described, will be retained, and the lamp 16' is clamped at a higher elevation on the standard 12 by means of its clamping member 34.

Another arrangement for drying the side of a tractor would include the same pattern as last described, but with the lamp 16'removed, and the lamp arm 14 removed and reclamped at the position 14' so that the lamp 15' will occupy the position 15'', as illustrated in phantom in FIG. 3.

The side of a pickup truck or van can be dried with an arrangement in which only the lamp arm 14' is utilized with lamps 37 and 38 mounted on the lamp arm 14' so that their longitudinal axes extend vertically, as illustrated in phantom in FIG. 3.

It is thus apparent that various arrangements and numbers of lamp arms 13, 14 and/or 14' may be utilized with various numbers and spacings of lamps 15, 16, 15', 16', 15'', 37 and 38 , in order to maximize the drying efficiency of the dryer system supported by the dryer stand 10, depending upon the particular vehicle surface to be dried.

However, in order to maximize the stabillity of the dryer stand 10, the lamp arms and lamps should generally lie in the same vertical plane as the longitudinal axis of the base member 11, with all loads and weights balanced about the vertical standard 12, or with the resultant center of gravity of the combined array of lamps and lamp arms lying over the base member 11 and in the vertical plane of the longitudinal axis of the base member 11.

When it is desired to move the dryer stand 10 from one location to another, the standard 12 is merely tilted rearwardly to lift the feet 20 above the ground support surface so that the stand may be rolled upon the caster members 26 to the next desired location. Then the feet 20 are lowered to frictionally engage the ground support surface.

The straddle legs 19, when not straddling a wheel 22, can extend under the motor vehicle 23 in order to permit the lamp arm 13 and its supported lamp 15 to extend substantially over the top portion of the particular area of the motor vehicle corressponding to the position of the standard 12 along the side of the vehicle.

The elongated base member 11 mounting the standard 12 adjacent its proximal end provides a very stable support for the cantilevered lamp arm 13, or any other lamp 14 which is cantilevered in the same vertical plane as the longitudinal axis of the base member 11.

What is claimed is:

1. A motor vehicle dryer stand for supporting one or more dryer lamps in different positions to dry the finish on a motor vehicle, comprising, (a) a base member having a longitudinal axis, transverse dimensions, and remote and proximal end portions, (b) said base member comprising a platform member at said proximal end portion, said platform member having a proximal edge portion, (c) a pair of roller members depending from the proximal end portion of the base member, closely adjacent said proximal edge portion, and transversely spaced on opposite sides of the longitudinal axis of said base member to rollably engage a supporting surface, (d) said base member comprising a pair of elongated legs projecting remotely from said platform member and having free ends forming the remote end portion of said base member and terminating in depending foot members adapted to frictionally engage the supporting surface, (e) said free ends being spaced apart transversely on opposite sides of said longitudinal axis a distance substantially greater than the transverse spacing between said roller members and great enough to straddle the wheel of a motor vehicle, in a drying position, (f) an upright standard having a bottom end portion fixed to said platform member along the proximal edge of said platform member, on said longitudinal axis, and between said roller members and said foot members and projecting vertically upward from said base member, (g) an elongated lamp arm adapted to support a dryer lamp, said lamp arm being at least as long as said base member and long enough, when extending in the remote direction parallel to said longitudinal axis, to support a dryer lamp over the center portion of a motor vehicle in said drying position.

(h) clamp means adjustably securing one end of said lamp arm upon said standard at selectively different elevations relative to said base member, and (i) a reinforcing gusset member rigidly fixed to said standard and said platform member and projecting remotely from said standard above said platform member and disposed in a vertical plane on the longitudinal axis of said base member to resist the cantilever forces exerted by said lamp arm extending remotely from said standard.

2. The invention according to claim 1 in which said legs diverge remotely in a V-shape and intersect at said platform member, said platform member comprising a frame formed by the proximal extensions of said legs and a plate member fixed to said frame, the bottom end portion of said standard being fixed to the proximal edge portion of said plate member.

3. The invention according to claim 1 in which said platform member is less than half the length of said base member.

* * * * *